United States Patent [19]

Borzoni

[11] Patent Number: 4,563,666

[45] Date of Patent: Jan. 7, 1986

[54] MINIATURE FUSE

[75] Inventor: John Borzoni, Des Plaines, Ill.

[73] Assignee: Littelfuse, Inc., Des Plaines, Ill.

[21] Appl. No.: 616,901

[22] Filed: Jun. 4, 1984

[51] Int. Cl.[4] ..... H01H 85/02

[52] U.S. Cl. ..... 337/252; 337/186; 337/201; 337/231

[58] Field of Search ..... 337/252, 253, 254, 255, 337/251, 246, 227, 228, 231–236, 186, 187, 201, 208, 213, 214, 216, 260, 262, 263; 29/623

[56] References Cited

U.S. PATENT DOCUMENTS

| | | | |
|---|---|---|---|
| 3,291,939 | 12/1966 | Hitchcock | 337/279 |
| 3,348,007 | 10/1967 | Urani | 337/252 |
| 3,654,696 | 4/1972 | Wechsler | 29/623 |
| 3,913,051 | 10/1975 | Manker | 337/279 |
| 4,016,521 | 4/1977 | Seybold | 337/241 |
| 4,267,543 | 5/1981 | Arikawa | 337/255 |

*Primary Examiner*—Harold Broome
*Attorney, Agent, or Firm*—Russell E. Hattis

[57] ABSTRACT

A miniature fuse suitable for printed circuit applications and a manufacturing method therefor features preferably a generally rectangular elongated insulating body having a fuse element preferably diagonally disposed in a fuse cavity therein and terminals preferably insert molded therein and extending preferably from the opposite ends thereof. The cavity preferably opens onto opposite longitudinal sides of the body, but provision may be made to optionally close-off one of the cavity openings by a cover plate. The body is sealed by a sleeve which is preferably a semi-rigid expandable member but which could be a piece of expandable shrink tubing. Lay-in grooves preferably extend from the opposite ends of the cavity to conductive fuse attachment surfaces which are initially preferably bendable tabs located beyond the outer surface of the body to allow the fuse element to be conveniently attached or captured thereby during fuse assembly. The projecting tabs are then bent into the fuse body, and a preferably semi-rigid transparent insulating sleeve is then applied around and sealed to the sides of the body.

51 Claims, 33 Drawing Figures

FIG. 17A
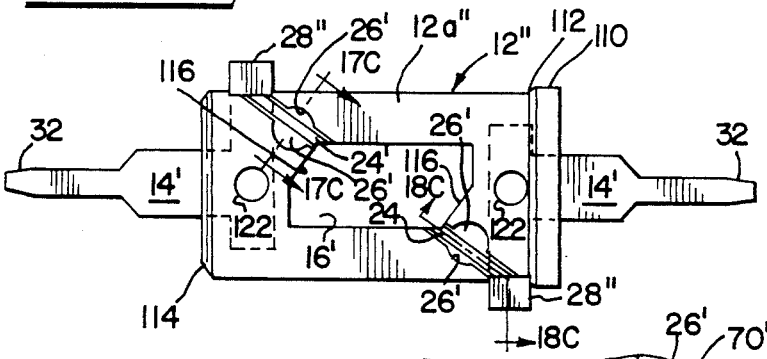
FIG. 18B
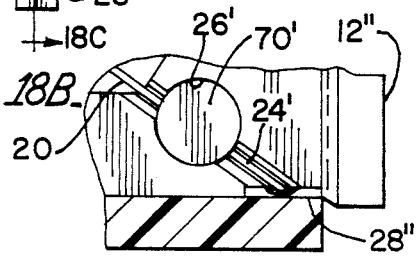
FIG. 17B
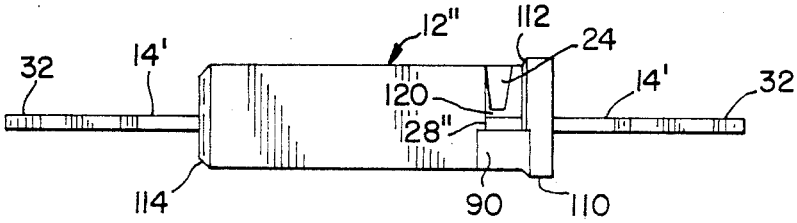
FIG. 18C
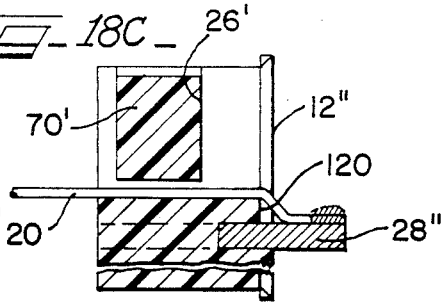
FIG. 18A
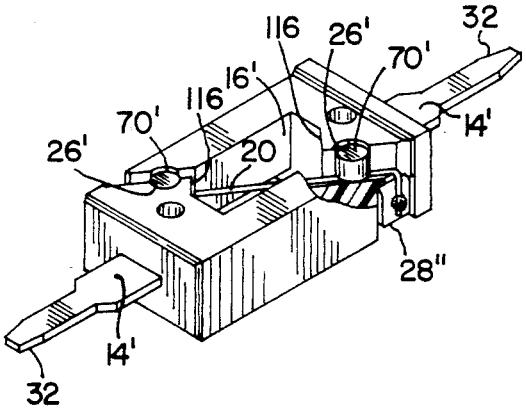
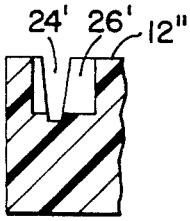
FIG. 17C

MINIATURE FUSE

TECHNICAL FIELD OF INVENTION

The technical field of the invention is the electrical fuse art. While many aspects of the invention have a broader application, the most important application thereof is in miniature fuses to be mounted on printed circuit boards. At voltages as high as 250 volts the miniature fuses of the invention are generally less than one inch long, and preferably less than one half inch long for most current ratings and no greater than about one quarter inch wide.

BACKGROUND OF THE INVENTION

When a fuse blows, an arc is developed which, if it spreads to the metal surfaces of the fuse terminals, will vaporize the surface layer thereof and create fuse exploding pressures. In an AC circuit, the arc generally becomes extinguished as the AC current drops to zero and may not restrike or cause rupture of the fuse if the pressures and temperatures in the fuse cavity can be held within acceptable limits. As fuse structures are made progressively smaller, it becomes more difficult to keep these parameters within desired limits.

There is a need in the printed circuit art for fuses of substantial voltage rating, i.e. 125–250 volts, and characterized by as small an overall dimension as possible. Such requirements are inherently in conflict, since a blowing fuse tends to generate rupture forces as a result of gas evolution and heating during the traveling of the arc along the fuse wire path and hence fuses capable of withstanding substantial restrike voltages during blowout typically must be fashioned with length greater than otherwise desired to allow the arc to extinguish and prevent rupture of the fuse casing. Should the casing rupture, there is an attendant fire hazard, as well as an attendant danger of damage to components on the printed circuit board itself. Printed circuit fuses should also have adequate protection against the entry of spray or dip solvents commonly used in the cleaning of printed circuit boards after final assembly of the components thereon.

To the applicant's knowledge, prior to the present invention there has not been designed a reliable sealed fuse much smaller than previous designs and capable of withstanding high energy fuse blowing conditions without destruction of the fuse housing. For example, there is a need for a reliable miniature printed circuit fuse which for a steady blowout current of 50 amps and 250 volts or equivalent energies can be made reliably as small as about 0.4 inches or less in overall length and even less in height and with a terminal spacing of the same dimension if desired (as when the terminals project axially from the fuse body ends and then bend downwardly). There has heretofore been developed cylindrical fuses with depending terminals within the boundries of the fuse and having a diameter of about 0.3 to 0.4 inches. The width of the fuses thus had to be greater than the terminal spacing and the height of the fuse was equal or greater than its width. Thus, at present, printed circuit fuses capable of withstanding such energies are relatively large, bulky fuses with cylindrical insulating bodies. Also such cylindrical fuses are too bulky for mounting on carrier strips wound on dispensing reels which can be conveniently inserted into automated machinery which automatically insert the fuses into the printed circuit board.

Fuses used on printed circuit boards generally comprise an insulating body defining a cavity or compartment in which a fuse element is suspended between fuse terminals which often project from opposite axial ends of the body and terminate in parallel confronting terminal ends pluggable into socket openings in the printed circuit board. Since the general objective in printed circuitry is miniaturization, it is desirable that the fuse itself occupy as little space on the printed circuit board as possible.

It is frequently required of some low amperage fuses that they use fuse wire of very small diameter, such as the order of 0.0003 inches, for example. There is an inherent difficulty in fabricating fuses using such delicate fuse wires since the tensioning and positioning of such elements during delicate soldering operations is typically a manual operation resulting in substantial labor costs. Thus, an adequately miniaturized high voltage fuse of relatively low blowout current which could be manufactured inexpensively by automated methods would be a useful contribution to the art. The present invention involves a unique design for a sealed fuse permitting a reliable fuse with such small fuse wire sizes and of a given current and voltage rating to be made even by automated means much smaller than conventional fuse designs of the same rating.

While some prior art miniature fuses have some features in common with the present invention, such as insulating bodies with cavities and fuse element lay-in grooves, axially projecting terminals and enclosing sleeves, these features are found separately in different fuses and have not been combined in the manner of the various features of the present invention. Also, the sizes and relationships of the grooves, cavities and terminals used in the present application are quite different from those of prior art fuses.

U.S. Pat. No. 3,913,051 issued to Manker et al discloses a miniature fuse comprising a body of insulating material having a small depression or well formed therein and having a fuse element which spans the well and rests upon metallized support surfaces on the body beyond the well. A pair of terminals have inner ends which overly and are secured by solder joints to the end portions of the fuse element. Shrink tubing tightly envelopes this entire assembly to seal the fuse interior from the ambient conditions of the fuse. Transparent tubing is used in the Manker et al fuse to allow visual detection of the blown fuses, but since the background for the fuse is the wall of the well behind the fuse, there is no clear view of the fuse element through the window produced by the transparent tubing.

The well in the Manker et al patent provides a space between the fuse element and the insulating body. This space is stated to be desirable to provide thermal isolation therebetween; however, in one form of the Manker et al invention, the tubing is shrunk into contact with the portion of the fuse element spanning the well. In such a case, the small well size provides a cavity for the fuse element which is under 10 percent of the overall volume occupied by the fuse. Another form of the invention is disclosed where the part of the shrink tubing overlying the central well-spanning portion of the fuse element is spaced from the central portion of the fuse element. The overall cavity size is still quite limited in this design and so it is unlikely that this fuse with a terminal spacing of 0.4 inches could withstand without rupture an arc in a 250 volt circuit. While some mention is made in the Manker et al patent of the fact that the shrink tubing is made of a flexible material, there is no mention or teaching in the patent that the tubing expands without rupture when the fuse blows so as to increase the size of the cavity to avoid the build-up of fuse rupturing forces as in the case of a fuse made in accordance with one of the features of the invention. If this were the intent of the flexible tubing, it is most likely the patent would have referred to such fact.

The prior art has used various techniques to increase the operating voltage of fuses by incorporating various arc quenching means therein. Thus, fuse elements have been surrounded by a suitable arc-quenching material. However, this approach is difficult to achieve in miniature fuses, or where very delicate fuse elements are used in the fuse. Another arc-quenching technique is to pass the portions of the fuse element immediately in advance of the points where they are soldered to the fuse terminals through restricted openings or grooves in the insulating material of the body involved, as shown by the fuse construction of U.S. Pat. No. 4,267,543, granted to Arikawa. This patent discloses a fuse structure employing a fuse element spanning a cavity defined between D-shaped insulating arc barrier-forming bosses in a cylindrical base portion of the fuse. The bosses are slotted to receive the fuse element and have recesses to receive and expose the terminals of the fuses to which the fuse element ends are soldered. A rigid cover overlies the base portion of the fuse. However, it is believed that the fuse design is inadequate to withstand without rupturing the pressures and temperatures present in a 250 volt circuit when made with a less than 0.4 inch exposed to arcing terminal separation. Furthermore, because the circuit plug in terminals are spaced parallel pins, the overall size of such a fuse would be much greater than the terminal spacing.

Applicant before the present invention designed and built fuse constructions constituting improvements on the Manker and Arikawa fuse designs. These fuse constructions comprise a housing including a base portion carrying the circuit plug-in terminals of the fuse and defining part of the fuse cavity and fuse element lay-in grooves at the opposite ends of the fuse cavity. A cover encloses the base portion of the fuse housing and supplies depending ribs which extend into the lay-in grooves so that the fuse element is surrounded on all four sides by masses of insulating material at each end of the fuse element immediately ahead of the point where the fuse element is soldered to the adjacent fuse terminal. The cover and base of the housing are ultrasonically welded together. This type of fuse construction, while believed to be an improvement over the Manker et al and Arikawa fuse designs, did not always withstand the fuse rupturing forces in 250 volt or other high energy circuits. Thus, prior to the present invention, there was still a need for a miniature fuse which could be readily manufactured, preferably by completely automatic assembly techniques, which was spray and or dip solvent resistant, could withstand high arc energies preferably as high as those present in 250 volt circuits without explosive rupture, and wherein a blown condition could be readily detected by visual inspection. However, the broader aspects of the invention are not limited to fuses for use in 250 volt circuits.

SUMMARY OF INVENTION

In accordance with one aspect of the invention, the fuse comprises an insulating body defining a fuse element-receiving cavity, the body being enveloped by a closely fitted expandable sleeve designed to use the sleeve flexibility to increase the fuse cavity volume without rupturing by at least about 30 percent under the fuse blowing conditions involved. Unlike the insulating body of the Manker et al fuse, the insulating body of the fuse has a relatively large cavity opening onto at least one side thereof, and preferably has a volume of at least about 20 percent of the overall volume occupied by the body. Preferably the cavity opens onto both opposite longitudinally extending sides of the body. Thus, for example, the insulating body could be a horizontally elongated rectangular shaped body having a cavity formed by a relatively rectangular shaped aperture extending completely through the body. An expandable sleeve or tube, preferably a semi-rigid tube, surrounds and engages the longitudinal sides of the insulating body to seal off all of the open sides of the body cavity at points in spaced relation to the fuse element, the element being preferably suspended in the central portion of the cavity. The sleeve thus forms two expanding wall sections on the open sides of the insulating body cavity, the wall expanding without breaking when the fuse blows.

The expandable sleeve of the present invention is preferably transparent so that the fuse element can be readily viewed. In the form of the invention where the cavity opens onto opposite lateral or longitudinal sides of the insulating body, a clear view of the fuse element is obtained because the transparent walls of the tubing form a backlighted fuse element when the fuse is held up to a light or viewed in daylight. However, for the very highest voltage and current rated fuses, a cover plate is fitted into a recess on one side of the body to close off the bottom side of the cavity, to form a well to receive an arc-quenching filler fed through the upper cavity opening prior to application of the sleeve.

U.S. Pat. No. 3,291,939, issued to Hitchcock shows the use of a resilient sleeve 5' surrounding a fuse element 3' passing through an opening in an insulating board and diagonally supported between the two ends of copper coatings on opposite faces of the board. The purpose of this sleeve is to localize the travelling arc during burnout to a narrow channel proximate to either surface of the printed circuit boards comprising the end terminals of the structure, so as to provide "a significant elongation of the arc and a significant increase of the arc voltage at a period of time following arc initiation rather than at the time of arc initiation." This patent makes no mention of the concept of using the expansion properties of the sleeve about a confining chamber to provide pressure relief thereto, the function of the sleeve instead being to retain a high local pressure in the vicinity of the ends of the contacting members to force confinement of the arc as it burns along them.

It is here noted that U.S. Pat. No. 4,016,521 to Seybold discloses a thermal limiter switch, rather than a fuse of the type of which the present invention deals, which has a housing with a small wall area which expands permanently when a threshold temperature is reached to provide a very limited degree of expansion of the switch interior and for a completely different purpose than that of our sleeve. Thus, the expandable wall section of the fuse housing disclosed in this patent stays expanded when the threshold temperature has been exceeded to act as an indicator that the thermal limiter device has been triggered. The high current fuse blowout rupture protection using a resilient wall must not depend upon such a thermally induced plastic softening, since the pressure surges are too rapid to allow the requisite temperature buildup.

In accordance with another feature of the invention which preferably but not necessarily uses an expandable sleeve over the cavity-defining insulating body, the fuse terminals are preferably insert molded into the insulating body and extend from opposite longitudinal ends of the insulating body previously described. The body has preferably diagonally aligned fuse element lay-in and arc-inhibiting grooves extending from diagonally opposite margins of the cavity to the opposite longitudinally extending sides of the body and adjacent to terminal fuse element attaching surfaces.

The lay-in grooves preferably extend to the opposite longitudinally extending sides of the insulating body so that when the fuse element is laid into the grooves, the ends of the fuse element preferably extend beyond the groove ends, so that after portions of the fuse element are soldered to the tabs or other exposed surfaces of the fuse terminals they can be conveniently pinched-off beyond the points where they are soldered. This aids in the automated mass production of the fuses where the fuse element is dispensed to the fuse assembly station from a reel thereof. The defining walls of the lay-in grooves act as arc barriers to inhibit expansion of an arc to the vicinity of the tabs or other exposed terminal surfaces to which the fuse filament is soldered. Parts of these grooves are preferably enlarged to form solder or insulating plug-receiving recesses to be described. These recesses open onto the same side of the insulating body to which one side of the body cavity opens. The various cavity and lay-in groove openings are sealed preferably by a transparent open-ended sleeve which is slipped over the insulating body from one end thereof. While the sleeve can be shrink tubing, it is preferably a semi-rigid sleeve which is sealed as by ultrasonically welding it around the opposite ends of the insulating body. While the previously mentioned Arikawa patent discloses a fuse with an insulating body with lay-in grooves, it is otherwise of quite different construction than the fuse just described.

In sub-miniature fuses of the size of the preferred form of the invention, the areas of the exposed terminals to which the fuse filament is to be soldered are flat surfaces to maximize the soldering areas. The terminals are thus preferably of a blade or ribbon configuration and in the latest and most preferred design include bendable extension tabs which initially preferably extend parallel to the longitudinal side surface of the insulating body upon which the cavity and lay-in grooves open and project beyond the sides of the insulating body where they are readily accessible. These exposed terminal tabs are subsequently bent down to where they are within the confines of the insulating body and are well below the bottom of the lay-in grooves, so that the exposed metal surfaces of the terminals are far from the straight line path of movement of an arc expanding outward in the grooves, should the arc not be extinquished by the time it reaches the end portions of the grooves.

Still other features of the invention deal with the manner in which the fuses are assembled on a metal carrier strip from which the fuse terminals are formed and on which the insulating bodies are molded. Still other features of the invention will become apparent upon making reference to the description to follow, the drawings, and the claims.

BRIEF DESCRIPTION OF DRAWINGS

FIGS. 17*a* and 17*b* are plan and side elevations of a third version of a fuse body configured to accept a preformed flexible cover;

FIG. 17*c* is a cross-section view of a portion of the fuse body of FIG. 17*a* showing details of a passage configured to accept insulating arc-quenching plugs;

FIG. 18*a* is a perspective partially cutaway view of the fuse body of FIGS. 17*a* and 17*b* showing a fuse element in place and soldered to end terminal portions;

FIG. 18*b* is a partial plan view view of the corner region of the fuse of FIG. 18*a;*

FIG. 18*c* is a fold-out cross section view of the fuse of FIG. 18*a* taken along the mid-points of the lay-in groove and terminal portion as indicated by appropriate axes in FIG. 17*a*; The fold-out cross-section of FIG. 18*c* refers to the structure shown in FIG. 18*a* with insulating plugs in place, and before folding down the terminals.

DETAILED DESCRIPTION OF THE INVENTION

FIGS. 1-5 show various views of a fuse 10 illustrating the earliest developed form of the present invention. The fuse 10 has a generally rectangular insulating body 12 made of a suitable synthetic plastic material and having integrally insert molded therein terminals 14 generally flat or planar in form. The terminals are preferably disposed in the midplane region of the fuse body 12 into which the terminals are insert molded in a manner to be described and project longitudinally from opposite ends of the body. In use the terminal ends are bent down into parallel confronting relation to plug into socket openings in a printed circuit board. The fuse body preferably has a centrally located generally rectangular cavity 16 preferably passing completely through the body so as to open upon two major faces of the fuse body 12.

Figure 1:
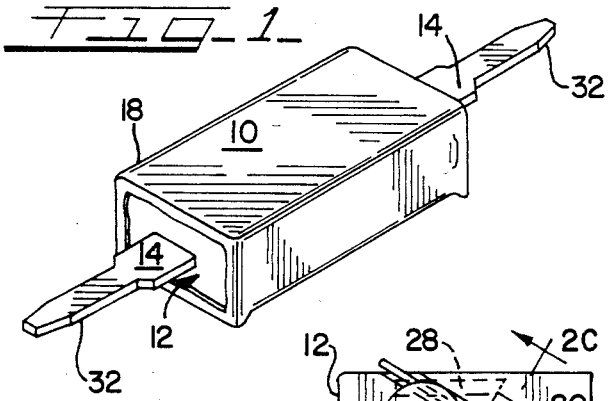
FIG. 1 is a perspective view of an embodiment of the sub-miniature fuse of the present invention, showing a generally rectangular fuse body having axial leads extending from opposite ends thereof, the fuse body being encapsulated by a heat shrunk tubing.
Figure 5:
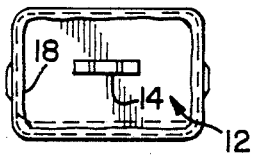
FIG. 5 is an end view of the fuse shown in FIG. 1.

As shown in FIG. 1, the terminals 14 in the completed fuse are normally left in a condition where they are in a single parallel plane so that the fuses can be in-line packaged for shipment to the location where they are to be applied to printed circuit boards. Such packaging may include a flexible carrier strip (not shown) to which the individual fuses are secured in longitudinally spaced relationship to the strip, with the terminals projecting laterally from the strip. The strip is wound on reels for shipment and storage, and is unwound to be received by automated fuse feeding equipment which bends the terminal end portions 32 down to form spaced, confronting terminal ends (see FIG. 4) which are inserted into printed circuit board openings after being separated from the carrier strip.

Each terminal 14 has an interior nonbendable terminal tab portion 28 extending laterally to one side of the fuse body and having a forwardly extending terminal tab tip 30 (FIGS. 2A, 6, 8 and 9). The terminal tab portions 28 are located at diagonally opposite margins of the fuse body 12, that is, on opposite sides of the longitudinal axis thereof.

A pair of aligned, narrow, diagonally extending lay-in grooves 24 are provided in the top longitudinal side or surface 12*a* of the fuse body 12 as viewed in the drawing (FIG. 2A), the lay-in grooves opening for their full lengths to this top longitudinal surface. Solder-receiving recesses 26 in the top surface 12*a* intersect the grooves 24 to expose a portion of the surface of each terminal tab portion 28 and its associated tip 30. Each groove 24 extends to the outside of the fuse body through an exit opening or side passage 25 located on a longitudinal side surface 12*b* of the fuse body.

A fuse element 20 (which is shown as a fastblowing fuse filament) is laid into the lay-in grooves 24 so as to contact the terminal tab tips 30, electrical and mechanical contact being secured by solder pools in the recesses 22 contacting the upper faces of the tab tips. As will subsequently be discussed, the solder is preferably initially configured in the form of slugs pressingly inserted into the solder slug-receiving recesses 26 which are in effect enlarged portions of the lay-in grooves 24 extending, as shown, down to the upper surface of each terminal tab 28.

A sleeve 18, fabricated from shrink tubing is shrunk over the fuse body 12 sealingly to engage against the longitudinal surfaces thereof, thereby to seal the open ends of the fuse body cavity and to seal the lay-in groove and recess openings for reasons that will subsequently be discussed, snugly to secure the fuse element ends 36 to the sides of the fuse body 12. (However, as will be discussed, primarily for appearance and cost considerations, a semi-rigid expandable sleeve is preferred to this shrink tubing.) Stand-off ridges 34 (FIGS. 3 and 7), generally disposed parallel with respect to each other on the lower surface of the fuse body 12, serve to provide a standoff distance between the fuse body and the printed circuit board after installation.

Thus, it will be seen that the finished fuse has a fuse element 20 diagonally supported at the ends thereof so as to be suspended in free space within the volume created by the cavity 16 extending between the opposite faces of the sleeve 18. The diagonal lay-in groove orientation and the diagonal disposition of the fuse element makes the automated assembly of the fuse much easier, particularly with respect to shearing fuse element ends after capture where the fuse elements are parts of long lengths of fuse wire unwinding from a reel thereof in an automated assembly operation. This diagonal relationship also maximizes the cavity length spanned by the fuse element so as to improve the arc quenching qualities of the fuse design. The insert molding of the terminals in the fuse body assures sealing of the fuse interior for printed circuit board spray solvents at the axial ends of the fuse body, where the shrink tubing cannot readily seal the same. This is a necessary requirement for any fuse designed to be employed in printed circuit manufacture, wherein the final assembly of components is followed by a solvent rinse to remove soldering fluxes.

Of greatest importance to the arc quenching qualities and the integrity of the fuse of a given desired small size is the design of a support body providing a cavity of appreciable size (e.g. at least about 20 percent of the overall volume of the fuse body as compared with the much smaller sized cavity of the Manker et al patent) combined with a preferably expandable sleeve which can expand without rupture to increase the cavity volume preferably at least about 30 percent. In such case, it is believed the expanding tube provides vent clearance spaces to relieve further pressures in the cavity when the fuse blows. Thus, a maximum expansion volume consistent with the overall geometry of the fuse body 12 is secured. By preferably designing the fuse body cavity to open onto opposite longitudinal faces of the fuse body 12, the cavity terminates in an expandable wall on two sides of the support body (as compared to one side in the Manker et.al. fuse) so that any shock wave produced by the explosive burnout of the fuse element 20 under high current high-voltage conditions strikes two expandable walls. The result is that transient overpressures are substantially minimized by the outward expansion of the sleeve 18, and thus the ability of the fuse to withstand explosive burnout is markedly improved. Also, by providing a clear sleeve 18, blown fuses may be easily visually detected. Polyvinylidene fluoride tubing having a pre-shrunk diameter of 0.250 inches and a wall thickness of 0.008 inches has proven satisfactory for such purposes.

Figure 2B:
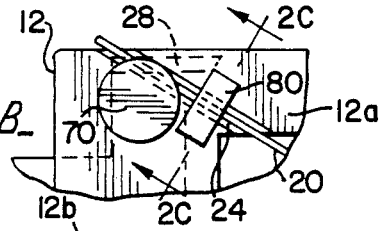
FIG. 2B is a partial plan view of the exposed fuse element attachment region of FIG. 2A, showing an alternative fabrication wherein a rectangular melt-in region is produced in the fuse body to completely enshroud a portion of the element.
Figure 2C:
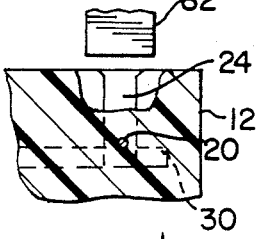
FIG. 2C is a partial cross section view of the melt-in region shown in FIG. 2B, showing an encapsulated element. A melting tool is shown disposed above the melted region.
Figure 2A:
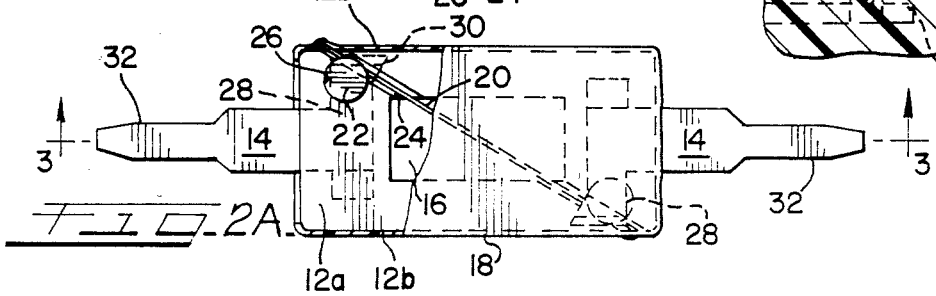
FIG. 2A is a partially sectioned plan view of the fuse of FIG. 1, with a portion of the top of the tubing cut away, and showing a fuse element diagonally disposed across an expansion chamber and captively secured in diagonally extending grooves by means of cylindrical solder attachment slugs.
Figure 3:
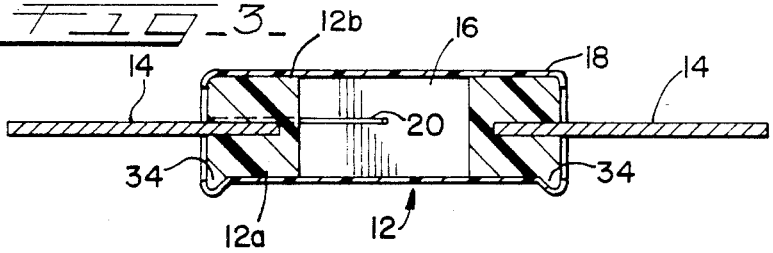
FIG. 3 is a longitudinal cross sectional view through the fuse shown in FIG. 1.
Figure 4:
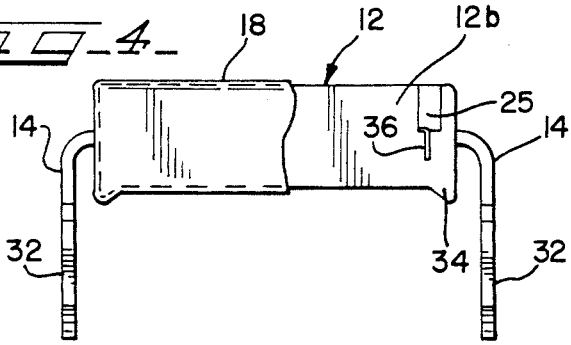
FIG. 4 is a view corresponding to FIG. 3, with part of the shrink tubing portion thereof broken away to show the exiting of the fuse element at the side of the fuse body near one end terminal, and the terminals are shown extending downwardly from the fuse body in their normal disposition prepatory to insertion into a printed circuit board.

To provide additional arc quenching the lay-in grooves 24 may be filled with a suitable arc quenching material such as, for example, room temperature vulcanizing (RTV) silicone rubber. This RTV material is a pasty material which may also be used for the purpose of holding the fuse element in place in the grooves during the melting of solder pellets. An alternative fuse element hold-down means is indicated in FIGS. 2A and 2B. A portion 80 of the fuse body 12 in the vicinity of the lay-in grooves 24 may be locally melted by conventional ultrasonic techniques to hot-form local portions of the fuse body 12 around the fuse element 20 in that portion of the lay-in groove 24 between the terminal tab tips 30 and the cavity 16, so as to secure the fuse element 20 in place before soldering and assembly of the fuse is complete, and also to increase the arc-barrier qualities of the otherwise small but partially open entryway to the terminal tab tips. Detail FIG. 2C shows a completely encapsulated fuse element 20 immediately after hot-forming, the forming tool 82 being shown in the retracted position.

Prototype fuses constructed as shown in FIGS. 1–5 of the present application had a length of 0.375', a height of 0.100" and a width of 0.175". The insulating body cavity dimensions were 0.170" by 0.080". The width of the entryway to the lay-in grooves 24 was 0.015". This fuse routinely withstood blowout currents of 50 amperes and 250 volts AC without rupturing. Thus, the chamber volume exceeds 20 per cent of the overall body volume. Actual measurements showed that membrane flexure during blowout allowed a total chamber volume excess of about 30 per cent. Thus, by utilizing the maximum length of the structure more efficiently by laying the fuse element 20 in diagonally, and by providing a large expansion volume around the fuse walls, a miniature fuse of reduced dimension and substantially improved blowout characteristics has been achieved.

The fuse previously described and shown in FIGS. 1–5 is of such a design to lend itself readily to automated production techniques. Thus, referring to FIG. 6, the terminals 14 of large numbers of fuses are shown stamped from a carrier strip 40 of metal, most preferably plated copper sheet. The terminal pairs for each fuse are arranged in longitudinally spaced groups of laterally confronting pairs of terminals projecting from rectangular strip cut-outs 44' defined by lateral webs 44 between adjacent cutouts and support webs 45 between adjacent terminals. The webs 44 thus hold the terminals 14 in longitudinally spaced relation, with their interior laterally spaced ends forming the aforesaid tabs 28 and tip ends 30 in proper alignment to be insert molded in their associated fuse bodies as will be described. (While a similar molding operation to be described has been carried out in the fabrication of switches, the complete process to be described has not been utilized to the applicant's knowledge in making fuses.) Dotted lines 50 indicate where subsequent cutting operations will be performed to isolate the individual terminals 14. Indexing holes 46 spaced at appropriate positions along the strip 40 serve for positioning and automatic feeding operations.

Figure 7:
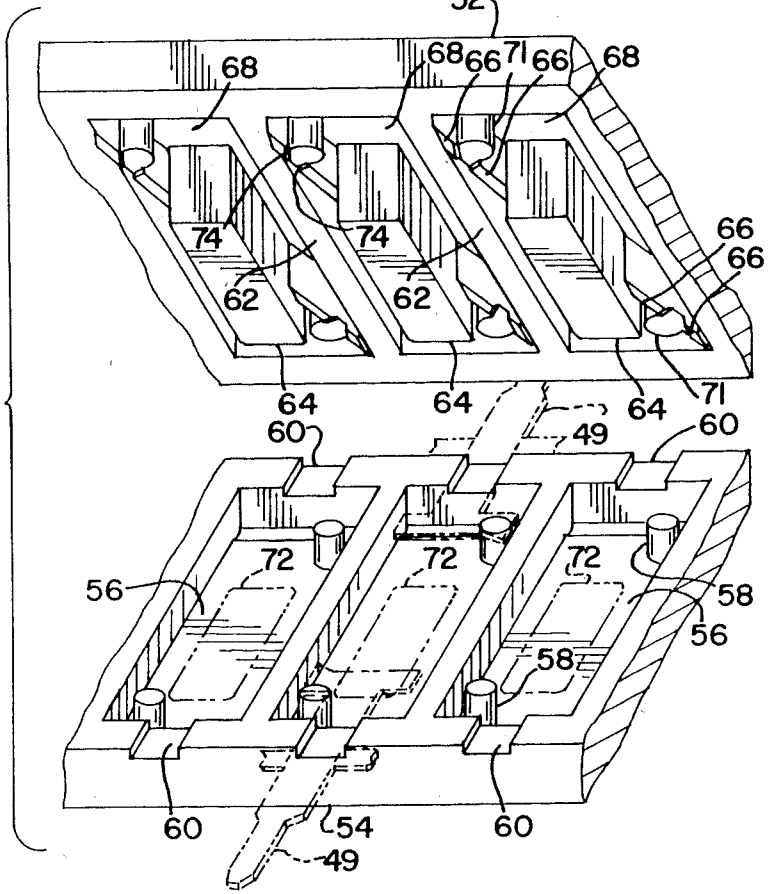
FIG. 7 shows upper and lower mold halves configured to captively retain the carrier strip of FIG. 6 as indicated by the dotted outline, so as to hold the terminal portions of the strips captively secured between the two halves of the mold for molding insulating bodies therearound.

The configuration of the carrier strip described permits a mass production operation to be effectively carried out wherein the carrier strip is advanced longitudinally in step-by-step fashion past various stations, one of which is a station where mold halves shown in FIG. 7 are brought down into position into one of the cut-outs 44' of the strip 4 where lower insulating bodies are molded at the same time. The mold halves could be configured to encompass more than one cut-out area, in which event more than four insulating bodies would be formed simultaneously at a particular section of the carrier strip.

FIG. 7 shows sections of two mold halves 52 and 54 configured to be placed around each group of terminal pairs 49 so as to mold fuse bodies 12 around the ends of the terminals 14. The lower mold half 54 is generally rectangular and upwardly open, and has a plurality of side-by-side oblong cavities 56 which will define the lower periphery of the fuse bodies. Extending upward from the base of each cavity 56 is a pair of terminal support posts 58 configured to provide support for one section of the carrier strip 40, the positioning of one pair of contacts 14 with respect to support posts 58 being shown in dotted line. Terminal access channels 60 in the form of shallow grooves in the top surface of the lower mold half 54 are aligned coaxially with the centerline of each cavity 56 to insertingly accept the intermediate portions 49 of individual fuse terminals 14 shown in the dotted outline in FIG. 7.

The upper mold half 52 is of complementary configuration to the lower mold half 54, having rectangular cavities 68 formed in a lower surface thereof and configured and located to match the cavities 56 of the lower mold half, each upper cavity 68 defining the upper face of fuse body 12 and the outer walls thereof. In each cavity 68 there is a generally rectangular fuse cavity-forming core 64 extending down from the upper surface of each mold cavity 68, the cores being configured to extend sufficiently far down from the upper mold half 52 to arrestingly engage the floor of each bottom mold cavity 56 in the lower mold half 54 as shown by dotted line 72, thereby defining during the molding process the fuse element cavity 16.

To form the lay-in grooves 24, projecting from the diagonally opposite ends of each core 64 is a groove-forming rib 66 extending downward from the floor of each cavity 68 and terminating coplanarly with isolation walls 62 surrounding each mold cavity 68. Integral with each rib 66, and extending down from the floor of each cavity 68 is a solder slug passage core 71 disposed at the adjacent corner of the mold cavity, the passage core being configured in the form of a cylindrical sector, the lower face of each soldered slug passage core being generally parallel with its associated rib 66, and slightly offset therefrom by joining facets 74.

Figure 6:
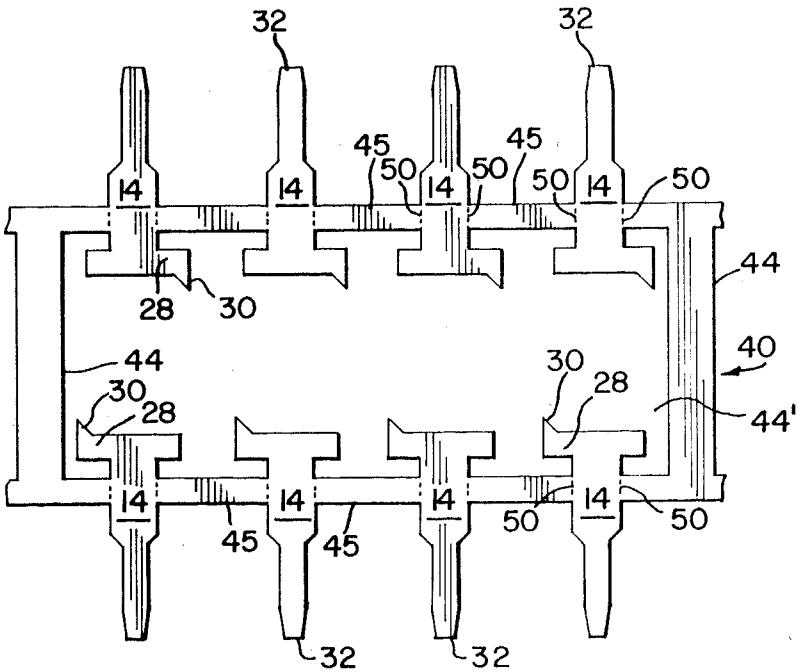
FIG. 6 is a plan view of a segment ~~of~~ a perforated carrier web or strip stamped to form a number of interconnected opposed pairs of fuse terminals positioned to be insert molded into insulating bodies interconnected by other portions of the strip.
Figure 8:
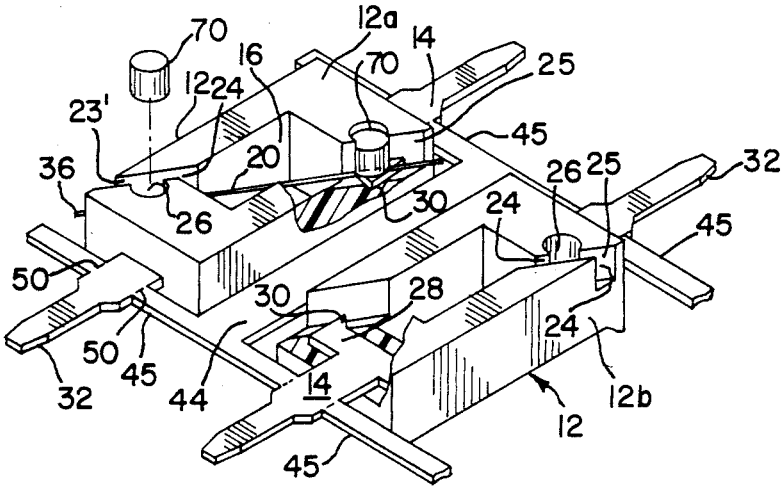
FIG. 8 shows a section of the terminal carrier strip of FIG. 6 after the molding operation is completed, and further showing a means whereby an inserted fuse filament is held captively secured by solder slugs pressed into recesses in the insulating bodies.

Thus, with a terminal strip 40 of the type shown in FIG. 6 laid over a lower mold half 54, the terminal tabs 28 of each terminal 14 being supported by terminal supports posts 58, the upper mold half is lowered into sealing engagement and each mold cavity is injected with a suitable molding plastic material to mold the fuse bodies 12 around their associated terminals, as shown in FIG. 8. A representative group of fuse bodies 12 is shown attached to the strip 40, the fuse bodies 12 being molded about terminals 14 with lay in grooves 24 and solder slug passages 26 extending down to expose upper surfaces of portions of the terminal tabs 28 and the terminal tab tips 30.

With an array of bodies 12 thus fabricated the fuse bodies and their terminal portions could be severed from the strip 40 and the other elements of the fuse added thereto. However, as illustrated, these other elements are added while the bodies 12 are still attached to the strip. In such case, fuse elements 20 may then be laid in diagonally as indicated in FIG. 8 so as to contact the upper surface of the exposed terminal tab tips 30, at which point soldered slugs 70 configured for press-in engagement with the slug passages 26 are pressingly inserted from above to temporarily secure the fuse elements 20 in contact with the tab tips 30. Each fuse element is then cut by conventional methods to leave individual ends 36 extending slightly beyond the groove side passages 23. The previously mentioned local melting operation indicated in FIGS. 2A and 2B may optionally be carried out at this point, or alternatively the RTV silicone filling operation may be carried out. If the solder slugs are to be melted after the shrink tubing is applied in the manner to be explained, neither one of these fuse element anchoring procedures need to be applied. The individual fuse body assemblies may be cut away from the terminal strips 40 by elementary shearing operations along the dotted lines as indicated in FIG. 8.

Figure 9:
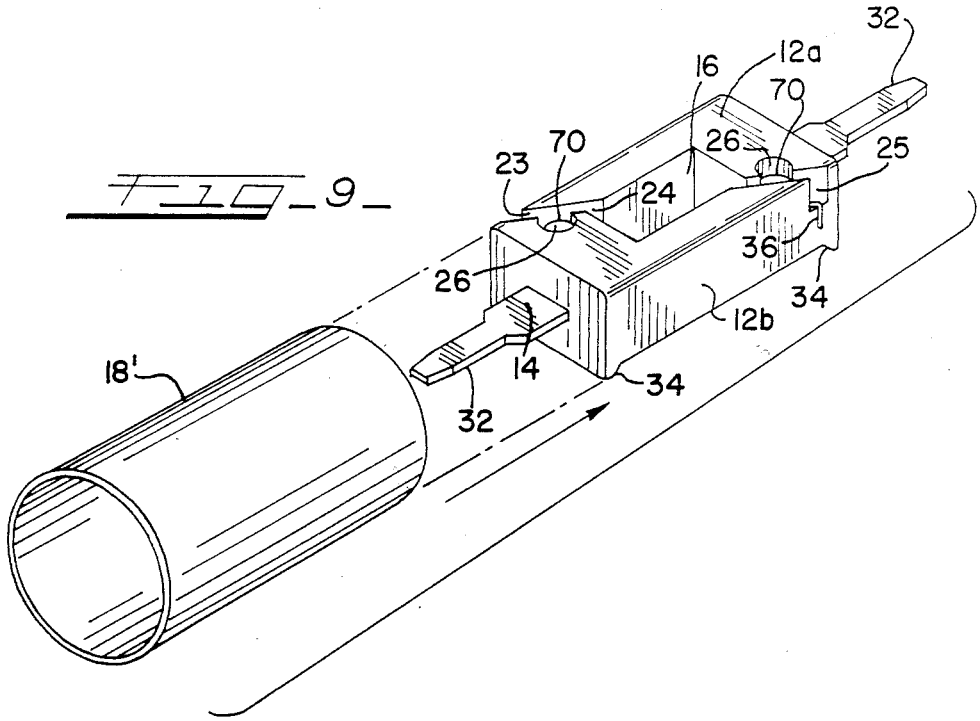
FIG. 9 is a perspective view of a fuse body assembly secured from the carrier strip of FIG. 8, with the fuse body assembly positioned to accept a length of heat shrinkable tubing to be slid therearound.

Next, the ends 36 of the fuse elements 20 extending from the groove passages 23 are bent downward into close proximity to the side walls of the fuse body 12 as shown in FIG. 9, after which operation a sleeve of heat-shrinkable tubing, is slid over the fuse body 12, the length of the sleeve 18 being somewhat in excess of the fuse body 12. The material of which the sleeve 18 is composed is chosen to have the property that the shrinking action can be carried out at temperatures below the melting temperature of the individual solder slugs 70. Each sleeve 18 is then heated in an oven or otherwise to shrink it in place as shown, thereby captively securing the fuse element ends 36 to the side faces of the fuse body 12, and also sealing the lay-in grooves 24, solder slug passages 70, and the groove side passages 23. It will be noted that, since the terminals 14 are integrally formed through the plastic body 12, the system is now completely spray or solvent dip resistant. Finally, each fuse 12 with its associated sleeve 18 shrunk into place, is heated in the same oven or otherwise melts the individual solder slugs 70, which causes them to flow over the exposed faces of the terminal tab 28 and the terminal tab tip 30, thereby soldering the fuse element 20 to the two terminals 14.

Thus, not only is an improved fuse provided, as previously described, but also there is associated therewith a mass assembly technique related to the design thereof providing for secure fuse element handling during intermediate phases of fabrication, and a complete sealing of the major faces of the structure, the entire assembly process being designed to be adapted to automatic handling techniques. Not only is an improved fuse produced, but the production method itself, utilizing the novel feature of the fuse design, is capable of producing such improved fuses in quantity by relatively inexpensive processes.

FIGS. 10–16 show an alternative version of the previously described fuse featuring a longer travel path for the burning arc as well as a pressurized constriction over the ends of the fuse wire at a point immediately adjacent to its point of attachment to the metal lead structure. Throughout the following discussion where identical functions and geometries are used as compared with the previously described embodiment, similar element designation numbers will be employed wherever possible.

Figure 10:
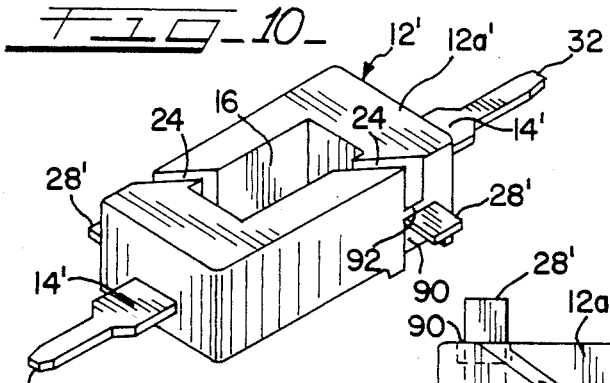
FIG. 10 is a perspective view of an alternative form of fuse body wherein the attachment points of the terminal tabs are initially disposed projecting outward of the fuse body generally below the bases of the lay-in grooves.
Figure 11:
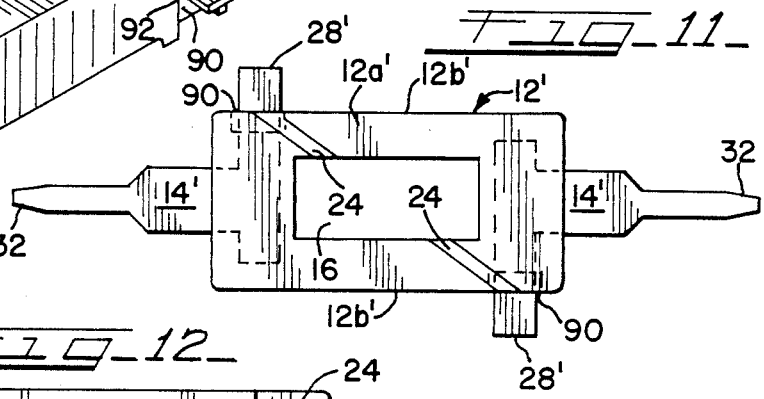
FIG. 11 is a plan view of the fuse body assembly shown in FIG. 10.
Figure 12:
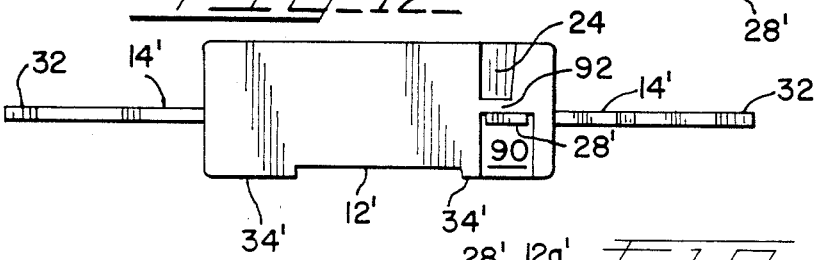
FIG. 12 is a side elevation of the body assembly shown in FIG. 11.
Figure 16:
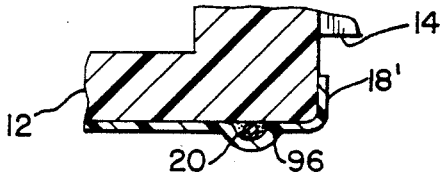
FIG. 16 is a partial cutaway view of FIG. 15 showing that region completely assembled with a tubing shrunk therearound so as to captively secure the end of the fuse element to the side wall of the body, and optional arc-quenching material therearound.

FIGS. 10–12 show a modified fuse body 12' with attached modified integral leads 14' immediately after the interconnecting carrier strips 45, as shown for example in FIG. 6, have been cut away. As will be evident from the drawings and the subsequent description of the modifications, the necessary modifications to the die structure shown in FIG. 7 and the strap structure shown in FIG. 6 may readily be carried out by those of ordinary skill in the art. Here the terminal tabs 28' are bendable tabs projecting from the two side longitudinal surfaces **12*b'*—12*b'* of the body 12' in a plane parallel to the top longitudinal surface 12*a'* thereof. Under each terminal bendable tab 28' is a recess 90 configured so that, as will subsequently be described, the terminal tabs may be bent downwardly to lie completely within the associated recesses, to be sealed thereafter by subsequent application of a sleeve like heat shrink tubing 18' (FIG. 16). In this case, however, it will be noted that the terminal tabs 28' are no longer generally coplanar with the base of the lay-in grooves 24, but are disposed generally therebelow, exiting the lateral walls of the fuse body 12', leaving a region 92 of each lateral wall (FIG. 15) between the base of the lay-in grooves 24 and the outwardly extending terminal tabs 28' The mounting feet 34' are similarly extended to accommodate each recess 90**.

Figure 13:
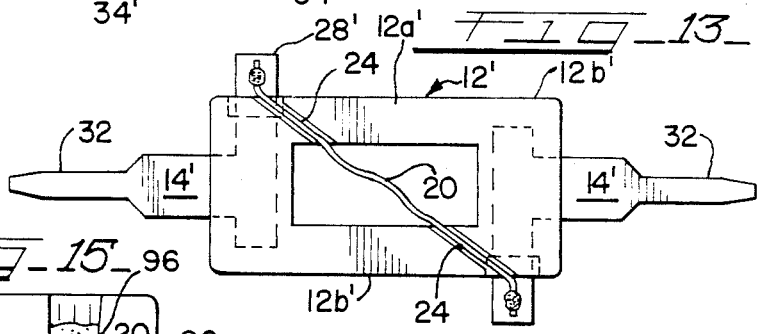
FIG. 13 is a plan view of the structure of FIG. 11 showing a fuse element laid into the lay-in grooves and attached to the outwardly extending terminal portions.
Figure 15:
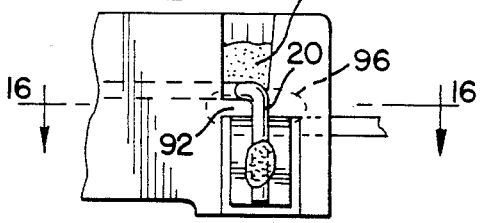
FIG. 15 is a partial side elevation of the assembly shown in FIG. 13, similarly showing the terminal portion folded down into side recesses, and also showing optional enplacement of arc-quenching material within the lay-in groove and also about the fuse element in the region where it traverses the outer wall of the fuse body.
Figure 14:
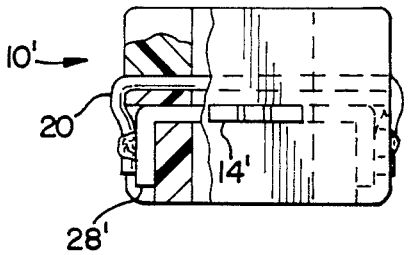
FIG. 14 is a partially sectioned end view of the structure of FIG. 13 showing the terminals folded down into side recesses and thereby causing portions of the fuse element to traverse a portion of the outer wall of the fuse body.

FIGS. 13–16 indicate the assembly process for such a structure. Initially, with the terminal tabs 28' extending laterally outward from the fuse holder body 12, a length of fuse wire 20 is diagonally inserted in the fuse holder body 12 to reside on the top surface of the two lay in grooves 24, the ends of the fuse wire being attached to the terminal tabs 28' by soldering or an equivalent process. As shown in FIG. 13, the fuse wire 20 is not secured in a taut condition, but is provided with a measure of slack for reasons that will become immediately evident. Next, the terminal tabs 28' with the ends of the fuse wire 20 permanently attached thereto are folded down by conventional mechanical deformation means to the point where they are generally coplanar with the base of recess 90 and completely contained therein FIGS. 14 and 15. It will be noted that the ends of the fuse wire 20 now pass over the wall section 92 between the base of the lay in grooves 24 and the top of the recess 90.

At this point there may be optionally added either into the lay-in groove 24, or along the wall strip 92, a suitable arc-quenching material 96 such as room temperature vulcanizing silicone rubber, epoxy cement, or related materials having suitable arc quenching properties. In the preferred embodiment, a material of such a type is to be applied over the fuse wire 20 in the region where it passes over the wall strips 92, a shrinkable tubing being then applied over the entire structure as previously shown in FIG. 9. Upon shrinking of the tubing the fuse wire 20 is pressed against the wall strip 92 at each end of the fuse holder body 12, to be completely surrounded by the arc-quenching material 96, and in addition to be trapped under substantial pressure, owing to the shrinking properties of the tubing 18'.

FIG. 16 is a cross section detail of the region of the wall strip 92 showing a captured fuse wire 20 pressingly surrounded by a shrunken sleeve 18, the void therebetween being filled by a suitable arc-quenching material 96. In the preferred embodiment, the arc-quenching material should be chosen such that it is capable of maintaining a non-flowing property throughout the shrinking operation of the tube. A variety of self-curing materials exhibit this property, including silicone rubber, as well as various epoxy cements. It will be appreciated that in this embodiment a substantially longer burning path is secured before the arc reaches the terminal tabs 28', and that the entrapment of the terminal portion of the fuse wire 20 in a pressure-sealed capsule region yields an additional measure of protection against explosive rupture of the system under high voltage conditions.

It is evident that the previously mentioned hot-forming technique described with reference to FIGS. 2A and 2B may be applied to this embodiment of the invention as well.

FIGS. **17*a*–19*d* show part and assembly details of miniature fuse having a modified insulating fuse body 12" FIGS. 19*a*–19*d* show the fuse as including a preformed open-ended semi-rigid sleeve 18" sealing and enclosing the fuse body. Considering first the fuse body 12" as shown in detail in FIGS. 17*a*–17*c* which show the fuse in a process assembly before the sleeve is applied, it will be noted that the yet unbent outwardly extending attachment tabs 28" are initially provided as in the previously described example of the invention. Cylindrical insulating plug-receiving recesses 26' extend down from the top surface 12*a* of the body 12", these recesses terminating slightly above the bottom of the lay-in grooves 24 as shown in the cross-section detail of FIG. 17*c*. As these are shown, the lay-in grooves 24' preferably have downwardly converging sides to facilitate fuse element insertion. It will also be noted that the previously rectangular cavity 16' has modified filled-in diagonally opposite corners 116 to permit an extension of the lay-in grooves 24'** further inwardly into the interior of the structure to increase the overall lengths thereof.

The fuse body is further provided with a generally rectangular flange-like end portion 110 joined to the remainder of the fuse body though a beveled step 112. The opposite end of the body 112 is configured with a beveled step 114, this step being beveled inward to a smaller dimension. These particular end configurations are particularly suited to the employment of a modified sleeve or cover which will be discussed subsequently.

FIG. **18*a* shows the fuse body 12" with a fuse element 20 inserted and secured, preferably by solder means, to downwardly folded terminal tabs 28" which are similar to and serve the function of the tabs 28' described in connection with the embodiment of FIGS. 10–16. These tabs 28" may be folded down after the fuse element has been first welded to the tabs 28". In such case, the fuse element is soldered subquently to the tabs to form a lower resistance connection either before or after the tab portions are bent down to remove slack in the fuse element. Alternatively, the fuse element need not be welded but it could be soldered to the tabs before or after they are bent down. Additionally, optional cylindrical insulating arc-quenching plugs 70'—70' are shown inserted into the recesses 26'—26' of FIG. 17*a*. These inserted plugs 70'—70' thus form a final top shrouding surface over the fuse element 20, and may be optionally caused by ultrasonic welding to flow completely into the base of the lay-in groove 24 (See FIG. 17*c*) to completely and contactingly surround end portions of the fuse element 20 between the chamber 16' and the metal contacting tabs 28". Alternatively, the recesses 26'** may be filled with a suitable arc-quenching material such as epoxy resin or a silicone compound.

With particular reference to FIGS. **18*b* and 18*c*, it will be noted that the downward bend at each end of the fuse element 20 after the terminal tab 28" is folded down as shown in FIG. 18*a* will pass over a corner 120 (FIG. 18*c*) of the fuse body 12" at the end of the associated groove. FIG. 18*c* is a foldout cross-section indicated by defining axes in FIG. 17*a*, and shows the attachment tabs 28" before folding them down. Thus, as in the case of the previous version described, a propagating arc has no straight line access to the metal of the terminal 32' or its portion attachment tab 28"**. Such a provision has been found to be markedly effective in reducing catastrophic failure under high current test conditions.

Figure 19A:
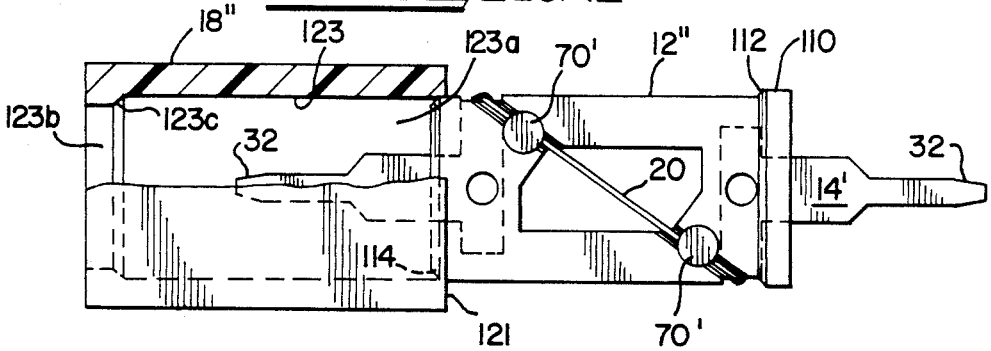
FIGS. 19*a*, 19*b*, and 19*c* are partially sectioned views of a preformed flexible cover in three stages of assembly over the fuse body.

With the fuse element 20 captively secured to folded-down terminal tabs 28'', the fuse body 12'' is ready for sealing. FIG. 19*a* shows a generally rectangular open-ended semi-rigid sleeve or cover 18'' defining a rectangular fuse body-receiving compartment 123 therein with a full similarly-shaped opening 123*a* at its front open end 121 and a reduced opening 123*b* at its rear end which merges with the compartment through a beveled step 123*c*. This preformed body 18'' is preferably transparent to allow for inspection for blown fuses, and must be sufficiently yielding in its properties so as to substantially assist in absorbing the overpressures encountered during high current fuse blow-out.

Figure 19B:
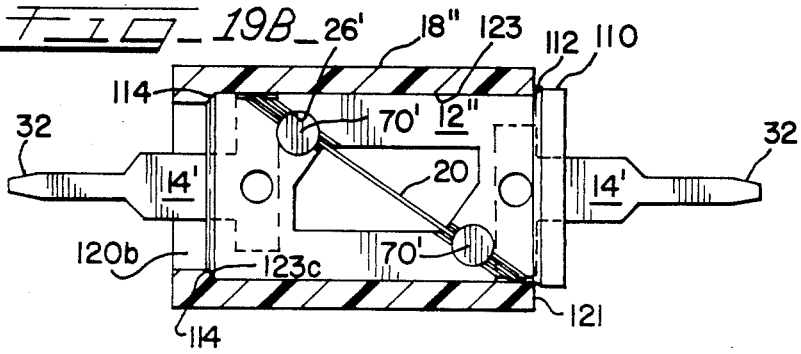

As shown in FIG. 19*a* and 19*b*, the front end 121 of the preformed sleeve 18'' is first slid over the smaller unflanged end of the fuse body 12'' until the front end abuts the beveled surface 112 of flange 110 of the body 12''. The sleeve 18'' is so dimensioned that when the right-hand end as shown in FIG. 19*b* contacts the beveled surface 112, the interior bevel 123*c* at the rear end of the sleeve 18'' simultaneously contacts the bevel 114 on the smaller end of the fuse body. The sleeve 18'' and the body 12'' are thus of the same overall length.

The cover 18'' is then hot-formed, preferably by ultrasonic welding, and slid further over the fuse body 12'' to form a sealing contact to the beveled portions 112 and 114 of the body 12'', as well as to the end portions of the fuse body immediately adjacent to beveled portion 114 and along the outer surfaces of the end flange 110. All passages to the interior of the fuse are now completely sealed, causing the fuse to be unaffected by complete solvent immersion. FIG. 19*d* shows the completed fuse 10''.

Figure 19C:
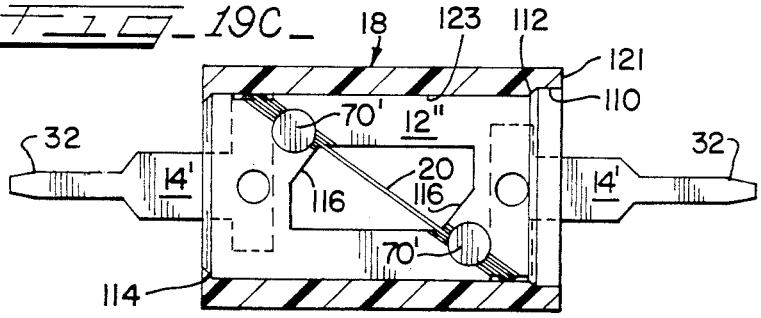
Figure 19D:
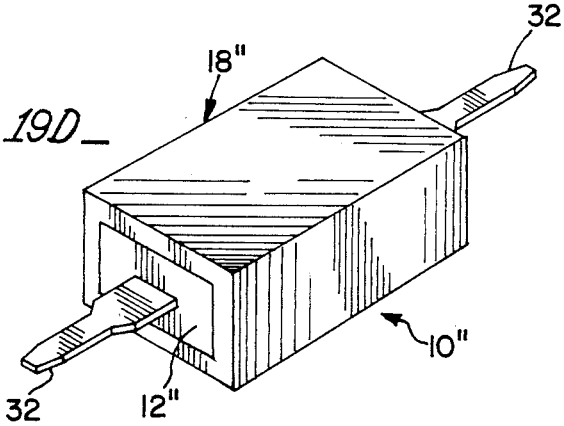
FIG. 19*d* is a perspective view of a final assembly shown in FIG. 19*c;*

With particular reference to FIGS. 19*b* and 19*c*, it will be noted that a slight clearance is provided between the interior walls of the sleeve 18'' and the fuse element 20 when the ends of the fuse element are in their folded-down condition. Nevertheless, the sleeve outer walls are sufficiently close to these portions of the fuse element to provide a substantial quenching action should the electrical arc succeed in penetrating past the arc-quenching plugs 70'—70' and attempt to reach the attachment terminals 28''. The overall dimensions of the finished fuse structure shown in FIG. 19*d* are a length of 0.345 inches, a width of 0.240 inches, and an overall thickness or height of approxiately 0.160 inches.

Because of the rigidity requirement the preformed sleeves 18'' should preferably have a wall thickness of the order of 0.030 inches, and be made of a clear plastic material of sufficient stiffness that in the dimensions recited the walls are essentially self-supporting so that the assembly of sleeves over the fuse bodies may easily be done by automatic machinery. This constitutes a substantial advantage over the previously mentioned methods employing heat shrinkable tubing, which proves difficult to handle in short lengths, and which requires elaborate handling and shearing machinery if dispensed from a long stock piece thereof. Also, the shrink tubing material is much more expensive than the semi-rigid materials from which the sleeves 18'' are made.

With respect to optimum choice of materials, particularly as applied to the preferred embodiment shown in FIGS. 17–19, the material from which the fuse body 12' is fabricated should optimally possess a variety of desirable properties. First, it should be non-charring, i.e. the propagation of any arc over or near the material should not cause local decomposition to a carbonaceous or other electrically conducting form. Such a charring property is known to contribute materially to explosive rupture fuse bodies under high current tests. Second, the body material should desirably evolve under fuse blowing conditions a gas having arc-quenching properties to assist in the extinguishing of a propagating arc. Third, the fuse body should remain dimensionally stable at the prolonged elevated temperatures produced by constant operation of a fuse at or near its rated maximum current. Fourth, the material employed must be compatible with injection molding techniques, and in particular those techniques which will sealingly and captively secure metal end terminals within the finished fuse body. Finally, the material must be sufficiently inexpensive so as not to render the cost of the finished fuse prohibitive.

Of a great variety of materials tested according to the foregoing criteria the optimum material for fuse bodies has proven to be polyethylene terephthalate resin.

With respect to the optimum sleeve material, the requirements for long term elevated temperature dimensional stability may be substantially relaxed, provided that that material does not undergo substantial sag into the central cavity under such circumstances. Further, the sleeve material must be transparent and heat sealable to polyethylene terephthalate resin and compatible with exposure to commercial cleaning solvents. Because of the necessity for providing a shock-absorbing feature, the material must be capable of a reasonable degree of expansion under high current blow-out conditions without undergoing rupture, any such rupture constituting a substantial fire hazard. As in the case of a fuse body, it is essential that the cover material be of the type that does not decompose under high current blow-out to provide carbonaceous deposits.

Of a great variety of materials tested, the only materials found to fulfill all of the above mentioned characteristics are polysulphone and polyethersulphone.

By using the above mentioned materials, fuses of the type shown in FIG. 17–19 having nominal ratings up to 5 amperes will routinely survive 250 volt ac 50 ampere blow-outs without undergoing explosive rupture. To the applicant's knowledge, no other known fuses having these dimensions can pass such a test.

Figure 20:
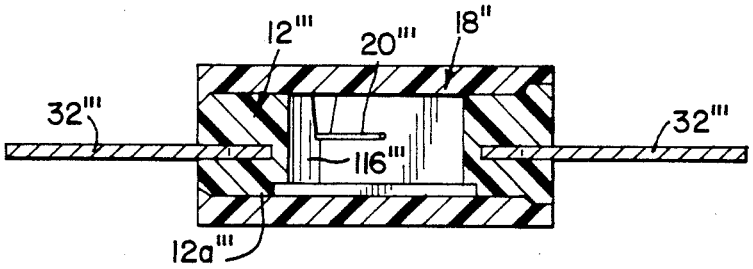
FIG. 20 is a longitudinal sectional view through another variation of the miniature fuse of the present invention.
Figure 21:
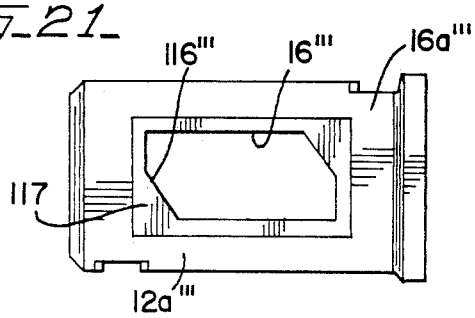
FIG. 21 is a bottom view of the insulating body portion of the fuse shown in FIG. 20 separated from the rest of the fuse and showing a shelf on the bottom of the insulating body surrounding the cavity thereof which shelf can receive a closure plate when it is desired to fill the fuse with an arc quenching material to withstand higher fuse blowing energies.
Figure 22:
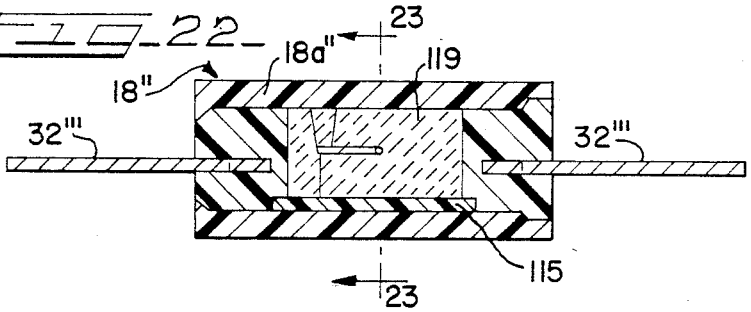
FIG. 22 is a longitudinal sectional view through the fuse shown in FIG. 20 with the cavity-closure plate in place within the fuse and an arc quenching material filling the space of the cavity above the closure plate.
Figure 23:
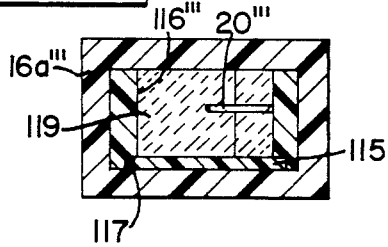
FIG. 23 is a transverse sectional view through the fuse shown in FIG. 22, taken along section line 23—23 therein.

Refer now to FIGS. 20–23 which show a fuse 10''' wherein prior to the application of the insulating sleeve 18'', the cavity 16''' of the insulating body 12''' can be filled with an arc quenching material when the fuse is to be used to interrupt extremely high energy currents requiring this additional arc quenching material. However, in FIGS. 20 and 21 the insulating body cavity does not contain the arc quenching material but to standardized on the configuration of the insulating bodies, the insulating body is adapted to receive a cavity cover plate 115 shown in FIGS. 22 and 23. The fuse shown in FIGS. 20 and 21 are identical to that shown in FIGS. 17–19*d* except that the bottom surface 12*a'''* of the insulating body 12''' is provided with a recess forming a ledge or shoulder 117 surrounding the margins of the cavity 16'''. This recess is sufficiently deep to accommodate the thickness of a cavity cover plate 115 shown in FIG. 22 which forms a bottom wall in the cavity 16''' so that the cavity can be filled through the open top thereof with a suitable arc quenching material 119. The open top of the cavity 16''' is sealed by the sleeve 18'' shown in FIG. 22 and 23. The elements of the fuse 10''' which correspond to the elements of the fuse shown in FIGS. 17–19*d* are indicated by corresponding reference numbers except that a triple prime (‴) has been added to the numbers in FIGS. 20–23.

Figure 24:
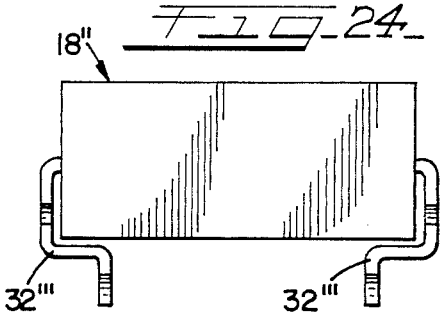
FIG. 24 is a view of a still further modified fuse which can have the configuration of any of the fuses shown in FIGS. 1-22 but differs from the configuration of these fuses in its unique fuse terminal configuration which permits the fuse to be plugged into socket terminals spaced apart only a fraction of the length of the fuse.

It will be recalled that when the fuse is used for printed circuit applications, the various fuses described have their terminals 14 bent downwardly into parallel confronting relationship so that they fit into socket openings in the printed circuit board. For safety purposes, it is believed desirable that a fuse which has a low voltage rating cannot be plugged into a circuit of higher voltage. Fuses having different blowing currents can be made of the identical size and configuration except possibly for the thickness or composition of the fuse element involved. Accordingly, the fuses previously described can have their terminals 14 bent into different configurations providing terminal ends spaced apart a given distance which varies with their voltage ratings. Corresponding sockets must obviously be provided on the printed circuit board. To this end, FIG. 24 shows the terminals 32‴—32‴ of the fuse shown in FIGS. 20–23 having initial short downwardly extending portion **14*a*‴—14*a*‴ terminating in inwardly and horizontally extending intermediate horizontal portions 14*b*‴—14*b*‴ which terminate in terminal ends 32‴—32‴** which plug into correspondingly spaced socket terminals (not shown).

While the invention has been described with reference to a preferred embodiment, it will be understood by those skilled in the art that various changes may be made and equivalents may be substituted for elements thereof without departing from the scope of the invention. Therefore, it is intended that the broad aspects of the invention not be limited to a particular embodiment disclosed as the best mode contemplated for carrying out the invention.

I claim:

1. A fuse comprising:

an elongated substantially rectangular body of insulating material having an elongated cavity therein with its long dimension parallel to the length of the body and opening onto at least one longitudinal side surface of said body;

a pair of terminals secured within opposite end portions of said insulating body and conductive fuse element attachment surfaces forming conductive extensions at the inner ends of said terminals beyond the margins of said cavity, said attachment surfaces being at diagonally opposite end portions of said body where they are on opposite sides of the longitudinal axis thereof, said terminals projecting from said body for making direct electrical connection to an external circuit;

said body having a pair of aligned narrow grooves extending outwardly from diagonally opposite margins of said cavity toward and in the vicinity of said attachment surfaces and opening onto opposite longitudinal sides of said body other than said one side so a fuse element can be dropped into the aligned grooves;

a fuse element disposed in said grooves and conductively secured between said exposed surfaces of said terminals and passing over or within an open side of said cavity, the defining walls of said grooves forming arc barriers to prevent expansion of an arc onto said attachment surfaces when the fuse element blows; and enclosure means for sealing all openings in the longitudinal sides of said insulating body.

2. A fuse comprising:

a body of insulating material having a cavity therein opening onto at least one longitudinal side surface of said body;

a pair of terminals secured within opposite end portions of said insulating body and conductive fuse element attachment surfaces forming conductive extensions at the inner ends of said terminals beyond opposite margins of said cavity, the outer ends of said terminals being exposed to the exterior of the fuse at the longitudinal ends of said body to make electrical connection to an external circuit;

said body having a pair of narrow grooves extending outwardly from opposite margins of said cavity toward and in the vicinity of said attachment surfaces and opening onto opposite sides of said body, said grooves being initially open over their full lengths onto said side surface of said body so that said fuse element may be laid into said grooves from said one side surface with the fuse element exiting said grooves;

a fuse element disposed in said grooves and conductively secured between said fuse element attachment surfaces of said terminals and passing over or within an open side of said cavity, the defining walls of said grooves forming arc barriers to prevent expansion of an arc onto said attachment surfaces when the fuse element blows;

and closure means enveloping the longitudinal sides of said body for sealing the openings in the longitudinal sides of said insulating body.

3. The fuse of claim 2 wherein said fuse element attachment surfaces are located beyond the ends of said grooves.

4. The fuse of claim 3 wherein said attachment surfaces to which the fuse element ends are attached face and are exposed respectively to a first pair of oppositely facing longitudinal surfaces of said body other than said one side surface thereof and are out of alignment with said grooves, the ends of said fuse element in said grooves exiting said grooves and then bending inwardly to engage said attachment surfaces, and there being no exposed metal surfaces in alignment with said grooves.

5. The fuse of claim 1 or 2 wherein said enclosure means is a semi-rigid insulating member enveloping said insulating body.

6. The fuse of claim 1 or 2 wherein said enclosure means is an open ended semi-rigid expandible insulating sleeve fitted longitudinally over said body from one end thereof and sealed around the opposite longitudinal ends thereof.

7. The fuse of claim 3 wherein said terminals are flat strips, with said attachment surfaces to which the fuse element ends are attachable are bent-over tabs which originally were in planes generally parallel to said one side surface of said body and near the ends of the grooves and projected beyond said body, and the tab extensions then being bent over so that the tab extensions extend close to said body.

8. The fuse of claim 7 wherein each of said terminal strips and associated tabs are integral portions of the same flat metal piece and are located in planar spaces below or inwardly of the bottom of said grooves so that when said tab extensions were bent they are moved further away from the ends of the grooves.

9. The fuse of claim 2 wherein said insulating body is molded around said terminals so that at the points where the terminals are exposed the interior of the insulating body is sealed from the exterior of the fuse.

10. The fuse of claim 1 or 2 wherein said enclosure means is an open-ended sleeve fitted longitudinally over said body from one end thereof and sealed around the opposite longitudinal ends thereof.

11. A fuse comprising:

a body of insulating material having a cavity therein opening onto at least one longitudinal side surface of said body;

a pair of terminals extending outwardly from opposite longitudinal ends of said body to make direct electrical connection with an external circuit and having conductive fuse element attachment surfaces forming conductive extensions of said terminals and located substantially beyond the margins of said cavity at opposite end portions of said body, said body having a pair of narrow grooves extending from opposite margins of said cavity toward and in the vicinity of said attachment surfaces;

a fuse element disposed in said grooves and conductively secured between said attachment surfaces and passing over or within an open side of said cavity, the defining walls of said grooves forming arc barriers to prevent expansion of an arc onto said attachment surfaces when the fuse element blows; and enclosure means for sealing the openings on the sides of said body communicating with said cavity, said enclosure means being an open ended insulating sleeve fitted longitudinally over said body from one end thereof and sealed around the opposite longitudinal ends thereof.

12. The fuse of claim 2, or 11 wherein said pair of grooves lie along a common diagonal line.

13. The fuse of claim 1, 2 or 11 wherein said attachment surfaces are positioned out of alignment with said grooves so that the fuse element ends bend over the body at the ends of said grooves to engage said attachment surfaces and an expanding arc has no direct line access to said exposed terminal surfaces or any other portion of said terminals.

14. The fuse of claim 1 or 11 wherein said grooves initially opened onto said one side surface of said body to form lay-in grooves for said fuse element and there is placed in said grooves over said fuse element an arc inhibiting material.

15. The fuse of claim 2 or 11 wherein said insulating body has a generally rectangular elongated shape with opposite longitudinal end faces and first and second pairs of generally parallel opposing longitudinal side surfaces, said cavity opening onto at least one of said second pair of side surfaces and said terminals projecting longitudinally from said end faces.

16. The fuse of claim 2 or 11 wherein said insulating body has a generally rectangular elongated shape with opposite longitudinal end faces and first and second pairs of generally parallel opposing side surfaces, said cavity opening onto at least one of said second pair of side surfaces and said terminals projecting longitudinally from said end faces, and said enclosure means is a semi-rigid rectangular insulating sleeve enveloping and presenting flat outer surfaces parallel to said first and second pairs of opposing side surfaces of said insulating body.

17. The fuse of claim 1, 2 or 11 wherein said terminals are insert molded into said body so that the terminals are exposed to the exterior of said body at points sealed thereby.

18. The fuse of claim 1, 2, or 11 wherein said enclosure means forms expandible wall means opposite said cavity which wall means expands substantially without breaking to increase the volume of said cavity under the pressures built up in said cavity when the fuse blows, to reduce the pressure and temperatures within the cavity and to assist in the complete quenching of the arc which develops momentarily when the fuse blows.

19. The fuse of claim 11 wherein said enclosure means is an open ended semi-rigid insulating sleeve fitted longitudinally over said body from one end thereof and sealed around the opposite longitudinal ends thereof.

20. The fuse of claim 11 wherein said cavity opens onto opposite longitudinal side surfaces of said body; and said sleeve is expandable opposite said cavity to absorb part of the energy generated upon blowing of the fuse at both cavity openings to avoid destruction of said enclosure means.

21. The fuse of claim 1, 2, or 11 wherein said cavity volume is at least about 20 percent of the volume occupied by the fuse body.

22. In a fuse comprising:

a body of insulating material having a cavity therein opening onto at least one longitudinal side surface of said body; a pair of terminals secured within opposite end portions of said insulating body and conductive fuse element attachment surfaces forming conductive extension at the inner ends of said terminals beyond the margins of said cavity, the outer ends of said terminals being exposed to make electrical connection to an external circuit, said body having a pair of narrow grooves extending outwardly from opposite margins of said cavity toward and in the vicinity of said attachment surfaces; said grooves extending outwardly from said cavity toward the opposite ends of said body and initially opening over their full lengths onto said one side surface of said body so that said fuse element may be laid into said grooves from said one side surface;

a fuse element disposed in said grooves and conductively secured between said exposed surfaces of said terminals and passing over or within an open side of said cavity, the defining walls of said grooves forming arc barriers to prevent expansion of an arc onto said attachment surfaces when the fuse element blows;

and enclosure means for sealing the openings in the sides of said insulating body, the improvement wherein said grooves in advance of said attachment surfaces are intersected by enlarged recesses opening onto said one side surface; and a rigid plug of insulating, arc-inhibiting material in each of said recesses and extending into contiguous relation with the fuse element in the bottom of said grooves.

23. A fuse comprising:

a body of insulating material having a cavity therein, said cavity opening onto opposite longitudinal sides of said insulating body through cavity openings thereat;

a pair of terminals secured within said insulating body at opposite ends thereof and conductive fuse element attachment surfaces forming conductive extensions of said terminals and located beyond the margins of said cavity, said terminals extending from said body to make electrical connection to an external circuit;

a fuse element conductively secured between said attachment surfaces of said terminals and passing over or within said open said of said cavity; and means for closing off the openings on the sides of said body communicating with said cavity and comprising enclosure means engaging said insulating body for sealing the openings in the sides of said body communicating with said cavity and forming opposite said cavity openings expandable wall means which expand substantially without breaking to increase the volume of said cavity under the pressures built up in said cavity when the fuse blows, to reduce the pressure and temperatures within the cavity and to assist in the complete quenching of the arc which develops momentarily when the fuse blows.

24. A fuse comprising:

a body of insulating material having a cavity therein, said cavity opening onto opposite longitudinal sides of said insulating body through cavity openings thereat;

a pair of terminals secured within said insulating body at opposite ends thereof and conductive fuse element attachment surfaces forming conductive extensions of said terminals and located beyond the margins of said cavity, said terminals extending from said body to make electrical connection to an external circuit;

a fuse element conductively secured between said attachment surfaces of said terminals and passing over or within said open said of said cavity;

said body having a recess forming a recessed ledge around one of said cavity openings upon which ledge a cavity closure plate can be secured to close off one end of said cavity, so that the cavity can be filled with an arc quenching material before the enclosure means is applied to the insulating body; and means for closing off the openings on the sides of said body communicating with said cavity and comprising enclosure means engaging said insulating body for sealing the openings in the sides of said body communicating with said cavity.

25. The fuse of claim 24 wherein said body has fuse element lay-in grooves between said cavity and fuse element attachment surfaces which grooves initially opened for these full lengths upon one of said longitudinal sides where one of said cavity openings are located, said recess forming said ledge surrounding the cavity opening on the opposite longitudinal side of the insulating body.

26. The fuse of claim 24 provided with said closure plate secured upon said ledge, and a filling of an arc quenching material in said cavity between said closure plate and said enclosure means.

27. The fuse of claim 1, 2, 11, 22, 23, or 24 wherein said body of insulating material has a length no greater than about one inch and a width no greater than about one quarter inch, and said cavity therein occupying at least about 20 percent of the volume occupied by the fuse body.

28. A miniature fuse comprising a fuse body of insulating material having a length no greater than about one inch and a width no greater than about one quarter inch and having a cavity therein of at least about 20 percent of the volume occupied by the fuse body and opening onto at least one longitudinally extending side of said body; a pair of terminals secured within said insulating body at opposite ends thereof and conductive fuse element attachment surfaces forming conductive extensions of said terminals, said terminals projecting from said body for making electrical connection to an external circuit; a fuse element conductively secured between said exposed surfaces of said terminals and passing over or within said open side of said cavity; and enclosure means closing off the openings on the longitudinal sides of said body communicating with said cavity, said enclosure means being an expandable sleeve providing expandable walls at all open sides of said body cavity which walls expand substantially without breaking substantially to increase the volume of said cavity under the maximum expected pressures built up in said cavity when the fuse blows, to reduce the pressure and temperatures within the cavity and to assist in the complete quenching of the arc which develops momentarily when the fuse blows.

29. The miniature fuse of claims 1, 11, 24 or 25 wherein said body is made of a polyethylene terephalate resin.

30. The miniature fuse of claims 1, 11, 27, or 28 wherein said enclosure means is a semi-rigid body made of one of the group consisting of polyethersulphone or polysulphone synthetic plastic material.

31. The fuse of claim 1 or 2 wherein each of said attachment surfaces and the associated terminal are integral portions of the same piece.

32. A method of making a miniature fuse comprising the steps of: providing a body of insulating material with a cavity opening onto at least one side surface of said body and a pair of terminals secured within said insulating body and projecting from opposite longitudinal ends of said body to make direct electrical connection to an external electric circuit, said terminals having conductive fuse attachment surfaces forming conductive extensions of the inner ends of said terminals and located beyond the margins of said cavity, said attachment surfaces being disposed adjacent to diagonally opposite ends of said body where they are on opposite sides of the longitudinal axis thereof, said body having aligned grooves extending longitudinally outwardly from opposite end portions of said cavity to oppositely facing surfaces of said body, the grooves extending to the vicinity of said attachment surfaces and opening onto said one side surface of the body for substantially their full lengths, so that the grooves are lay-in grooves into which a fuse element can be placed from said one side surface; orienting said body so that said cavity and one side surface of the body face upwardly where said cavity and grooves open to the top of the body; laying a fuse element in said grooves so it spans said cavity; mechanically and electrically connecting the ends of said fuse element to said terminal fuse attachment surfaces; and then applying an open ended sleeve longitudinally over said insulating body to seal off the open sides of the cavity and said lay-in grooves and sealing said sleeve around at least the opposite longitudinal ends of said body.

33. The method of claim 32 wherein said grooves lie along a common diagonal line so that when the fuse element is laid in said grooves, the fuse element does not then have to bend around any corners.

34. A method of making a miniature fuse comprising the steps of: providing a body of insulating material with a cavity opening onto at least one side surface of said body and a pair of terminals secured within opposite ends portions of said insulating body and exposed thereat for direct connection to an external circuit, bendable tabs which initially project from oppositely facing surfaces of the body, said body having aligned grooves longitudinally extending outwardly from opposite portions of said cavity to the vicinity of said tabs and opening onto said one side surface of the body for substantially their full lengths, so that the grooves are lay-in grooves into which a fuse element can be placed from said one side surface; orienting said body so that said cavity and one side surface of the body face upwardly where said cavity and grooves open to the top of the body; laying a fuse element in said grooves so it spans said cavity and extends to said tabs; bending said tabs downwardly and securing said fuse element to said tabs; and applying enclosure means to said body to seal off the open sides of the cavity and said lay-in grooves.

35. The method of claim 34 wherein said fuse element is attached to said tabs before they are bent down.

36. The method of claim 34 wherein said terminals and tabs are initially in planes below the bottom of the grooves.

37. The method of claim 32 or 34 wherein there are insulating plug-receiving recesses intersecting said grooves, and placing insulating plugs in said recesses after said fuse element is placed therein.

38. The method of claim 32 or 34 wherein said grooves extend between opposite margins of said cavity and a pair of opposite side surfaces of said insulating body; and when said fuse element is placed in said grooves the fuse element extends beyond the opposite side surfaces of said insulating body, and after said fuse element is physically and electrically attached to said attachment surfaces the end portions of the fuse element extending beyond the insulating body are severed from the rest of the fuse element.

39. The method of claim 34 wherein said terminals project longitudinally from opposite ends of said body and said enclosure means is an open-ended sleeve inserted longitudinally over said body and sealed around the same beyond the grooves and cavity.

40. The method of claim 39 wherein said sleeve is a semi-rigid body which is ultrasonically welded to the ends of said insulating body.

41. The method of claim 34 wherein the fuse terminals are insert molded within said insulating body so that the terminals are sealed thereto at the points where they are exposed to the exterior of said body; and said enclosure means being a single piece open-ended sleeve which is inserted over the insulating body and secured at least around the ends thereof where all of the openings of the insulating body are sealed thereby.

42. The method of claim 32 wherein said sleeve is a semi-rigid body which, after being slipped over the insulating body, engages around opposite longitudinal end portions thereof; and the sleeve is then ultrasonically welded to the end portions thereof.

43. A method of mass producing miniature fuses comprising the steps of: providing a carrier strip of conductive material from which are punched longitudinally spaced laterally confronting pairs of terminals, each pair of said laterally confronting terminals having spaced confronting inner end portions which form exposes surfaces to which the ends of a fuse element are to be connected; individually molding a body of insulating material around and extending between each of said pair of confronting inner end portions of each pair of terminals and which define a cavity therebetween leaving the outer ends of the terminals projecting therefrom and opening onto a side thereof, leaving exposed inner tip ends of said terminals; severing said strip at longitudinally spaced points therealong to separate the individual insulating bodies molded around parts of the inner end portions of said terminals; before or after the separation of said insulating bodies and pairs of terminals from said strip placing a fuse element between said exposed tip ends of each pair of terminals and mechanically and electrically attaching the ends of the fuse elements to said tip ends of each pair of terminals; and applying a sleeve around each insulating body to seal over the cavity and other openings on the sides of each body enclosed thereby.

44. The method of claim 43 wherein said carrier strip is provided with laterally extending webs at longitudinally spaced points therealong and defining longitudinally spaced cut-out sections in the strip, each of which includes a number of longitudinally spaced pairs of laterally confronting terminals, said molding of said insulating bodies being carried out by application of confronting molding parts which are brought into position within said cut-out areas to form a multiplicity of separate mold cavities for receiving the molding material which forms said insulating bodies, and said method including the steps of filling said mold cavities with insulating material to form said insulating bodies around parts of the inner end portion of each pair of confronting terminals, and, after the molding material has hardened, separating the mold parts from the carrier strip.

45. In a fuse comprising a body of insulating material having a cavity therein opening onto at least one side of said body; a pair of terminals secured within said insulating body and conductive fuse element attachment surfaces forming conductive extensions at the inner ends of said terminals beyond opposite margins of said cavity, the outer ends of said terminals being exposed to the exterior of the fuse to make electrical connection to an external circuit; said body having a pair of narrow grooves extending outwardly from opposite margins of said cavity toward and in the vicinity of said attachment surfaces and opening onto opposite sides of said body other than said one side, said grooves being initially open over their full lengths onto said one side surface of said body so that said fuse element may be laid into said grooves from said one side surface with the fuse element exiting said grooves; a fuse element disposed in said grooves and conductively secured between said fuse element attachment surfaces of said terminals and passing over or within an open side of said cavity, the defining walls of said grooves forming arc barriers to prevent expansion of an arc onto said attachment surfaces when the fuse element blows; and enclosure means for sealing the openings in the longitudinal sides of said insulating body, the improvement wherein said attachment surfaces to which the fuse element ends are attached are located beyond the ends of the grooves and face and are exposed respectively to said opposite sides of said body other than said one side thereof and are out of alignment with and are located in planes inside the ends of said grooves, the ends of said fuse element in said grooves exiting said grooves and then bending inwardly to engage said attachment surfaces, and there being no other exposed conductive surfaces in alignment with said grooves.

46. The fuse of claim 46 wherein said one side and opposite sides of said body are longitudinal sides of the body; said pair of conductive terminals project longitudinally from opposite axial end portions of the body, said conductive fuse element attachment surfaces are tabs forming flat fuse element attachment surfaces at diagonally opposite end portions of the body where they face and are exposed to said opposite longitudinal sides of said body; said grooves in said body extend from diagonally opposite ends of said cavity in the general direction of said fuse element attachment surfaces but at a level less deeply in said body than the location of said fuse element attachment surfaces and opening onto said opposite longitudinal sides of said body.

47. The fuse of claim 46 provided with inserts of insulating materials located in the path of the grooves and on the outside of the fuse element in advance of the points where the fuse element is secured to said attachment surfaces, so that these insulating inserts, along with the defining walls of said grooves, form arc barriers surrounding all sides of the fuse element to hinder or prevent expansion of an arc onto the attachment surfaces when the fuse element blows; and an insulating enclosure for sealing all openings in the longitudinal sides of the insulating body, said enclosure and insulating body also forming a restricted arc barrier passage at the points where the ends of the fuse element bend to engage the attachment surfaces.

48. The fuse of claim 7, 8, or 46 wherein said tabs are located in recesses on the opposite side of said insulating body, so as to be within the body but closely enveloped by said enclosure.

49. The fuse of claim 45 or 46 wherein said fuse body and enclosure have an overall length no greater than about one inch and an overall width no greater than one quarter inch, and wherein the terminals exit the fuse body at opposite longitudinal ends thereof where they abruptly bend downwardly to form parallel confronting plug terminals to be received in socket terminals.

50. The fuse of claim 1 wherein said narrow grooves of said body are aligned and extend diagonally outwardly from diagonally opposite margins of said cavity in said body.

51. The fuse of claims 2 or 11 wherein said cavity in said insulating body opens onto opposite longitudinal side surfaces of said body, and said enclosure means being transparent at least in the vicinity of said cavity openings.

* * * * *

UNITED STATES PATENT AND TRADEMARK OFFICE

CERTIFICATE OF CORRECTION

PATENT NO. : 4,563,666

DATED : January 7, 1986

INVENTOR(S) : John Borzoni

It is certified that error appears in the above-identified patent and that said Letters Patent are hereby corrected as shown below:

In column 24, line 59, replace "46" (second occurrence) by -- 45 --.

Signed and Sealed this

Seventh Day of April, 1987

*Attest:*

DONALD J. QUIGG

*Attesting Officer*

*Commissioner of Patents and Trademarks*